US005623989A

United States Patent [19]

Kröger

[11] Patent Number: 5,623,989

[45] Date of Patent: Apr. 29, 1997

[54] FINNED TUBE HEAT EXCHANGER

[75] Inventor: Detlev G. Kröger, Stellenbosch, South Africa

[73] Assignee: GEA Luftkühler GmbH, Bochum, Germany

[21] Appl. No.: 535,191

[22] PCT Filed: Feb. 23, 1995

[86] PCT No.: PCT/DE95/00239

§ 371 Date: Jan. 11, 1996

§ 102(e) Date: Jan. 11, 1996

[87] PCT Pub. No.: WO95/23949

PCT Pub. Date: Sep. 8, 1995

[30] Foreign Application Priority Data

Mar. 3, 1994 [DE] Germany ..... 44 06 966.9
Feb. 4, 1995 [DE] Germany ..... 195 03 766.9

[51] Int. Cl.[6] ..... F28F 1/20

[52] U.S. Cl. ..... 165/152; 165/181; 165/183; 165/DIG. 505

[58] Field of Search ..... 165/152, 181, 165/183, DIG. 505

[56] References Cited

U.S. PATENT DOCUMENTS 2,252,211 8/1941 Seemiller ..... 165/DIG. 505 X
3,515,207 6/1970 Lu .

FOREIGN PATENT DOCUMENTS

| | | | |
|---|---|---|---|
| 0490210 | 6/1992 | European Pat. Off. . | |
| 328959 | 1/1903 | France . | |
| 409013 | 11/1909 | France | 165/152 |
| 2108688 | 9/1972 | Germany | 165/152 |
| 169148 | 5/1934 | Switzerland | 165/152 |
| 362073 | of 1932 | United Kingdom | 165/152 |
| 392065 | 5/1933 | United Kingdom | 165/152 |
| 1197449 | 7/1966 | United Kingdom . | |

*Primary Examiner*—Allen J. Flanigan
*Attorney, Agent, or Firm*—Friedrich Kueffner

[57] ABSTRACT

The finned tube heat exchanger (1) has a plurality of elongated heat exchanger tubes (2) arranged parallel to one another and with a cross section, the length (L) of which is a multiple greater than its width (B). The heat exchanger tubes (2) are interconnected by fins (3) extending parallel to the direction of flow (SR) of the cooling air. Parallel adjacent air conduction grooves (7) running in the direction of flow (SR) of the cooling air, open at the fin ends (6) and in zig-zag array are made on at least one side surface of the fins (3). Said grooves are semicircular in cross section and consist of straight groove sections (8) and arc-shaped transition sections (9) steplessly interconnecting said straight sections. The groove sections may also be a component of zig-zag fin sections. Thus the groove sections still run obliquely to the longitudinal run of the fins.

16 Claims, 3 Drawing Sheets

FINNED TUBE HEAT EXCHANGER

BACKGROUND OF THE INVENTION

1. Field of the Invention

The invention relates to a finned tube heat exchanger, particularly for the condensation of exhaust streams of large turbine plants by cooling air.

2. Description of the Related Art

The finned tube heat exchanger according to DE-PS 34 19 734 is capable of condensing large quantities of steam. Moreover, it has the advantage that a pressure equalization occurs at any location of the heat exchanger tubes between all areas of the tube cross section. Consequently, the condensation of the exhaust steam ends in the forward tube sections facing the flow direction of the cooling air at exactly the same location as in the tube sections which are at the rear in flow direction of the cooling air. Accordingly, it is not likely that dead zones will be formed. Moreover, relatively large cross sections of the tubes are formed, so that the pressure losses due to the larger hydraulic cross section are significantly reduced.

The fins which project perpendicularly from the surfaces of the heat exchanger tubes are smooth and are constructed without projections.

In contrast to this finned tube heat exchanger, the finned tube heat exchanger according to DE-OS 19 58 909 has stop edges which are integrated in the fins between the heat exchanger tubes. The stop edges are formed by pressing surface portions out of the planes of the fins. Consequently, there are obstacles for the cooling air. The heat transfer is improved as a result of this measure, however, with the disadvantage that the pressure loss is increased by a multiple as a result of the stop edges.

SUMMARY OF THE INVENTION

Starting from the state of the art, the invention is based on the object of perfecting such a finned tube heat exchanger in such a way that the outer heat transfer between the cooling air and the surfaces of the heat exchanger tubes can be substantially increased without significantly increasing the pressure loss.

In accordance with the invention, the fins extend parallel to the flow direction of the cooling air and perpendicularly to the axes of the heat exchanger tubes. The fins have flow conduction devices in the form of air conduction grooves provided on at least one side surface of the fins, wherein the air conduction grooves extend in a zig-zag-shaped configuration parallel next to each other, and wherein the air conduction grooves extend continuously along the flow direction of the cooling air and are open at the fins ends Consequently, the fins are provided on at least one side surface with air conduction grooves having a zig-zag-shaped configuration. However, in spite of the zig-zag-shaped configuration, the air conduction grooves generally have an oblong extension in the flow direction of the cooling air. They are open at the fin ends and, thus, make it possible for the cooling air to flow in the air conduction grooves, wherein the zig-zag-shaped configuration produces a significantly improved outer heat transfer between the cooling air and the surface of the heat exchanger tubes without significantly increasing the pressure losses.

The air conduction grooves may extend over the entire side surface of a fin. The conduction grooves are preferably produced by embossing both sides of a fin. In that case, the air conduction grooves of adjacent fins are located frontally opposite each other.

The fins configured in accordance with the invention may be provided individually at each heat exchanger tube. However, it is particularly advantageous if two heat exchanger tubes located next to each other are connected to one another in the manner of webs by fins having zig-zag-shaped air conduction grooves. They may be individual fins or wave-shaped or U-shaped or trapezoidally embossed fin strips.

Although it is conceivable that the air conduction grooves are curved in the shape of waves, a preferred embodiment in accordance with claim 2 is seen in that the groove sections of the air conduction grooves which extend at an angle relative to each other are straight. The groove sections are preferably constructed with equal length.

For achieving a better air guidance, it is useful in accordance with claim 3 if two groove sections of an air conduction groove which are arranged following each other and at an angle relative to each other are steplessly connected to each other by an arc-shaped transition section. Each transition section advantageously is curved in the manner of a circular arc. The radii of the transition sections are advantageously identical.

A particularly advantageous embodiment of the fin configuration is seen in the features of claim 4. These features include either individual fins which are secured to the heat exchanger tubes through the fastening strips, or the fins form a component of wave-shaped, U-shaped or trapezoidally-shaped fin strips which are connected to the heat exchanger tubes through the fastening strips.

In this embodiment, the groove sections of the air conduction grooves which are provided in the individual fields and extend parallel to each other extend not only zig-zag-shaped in the longitudinal plane of each fin, but also at an angle relative to the general longitudinal extension of a fin. The fields with the groove sections of the air conduction grooves and the inclined slender triangular transition sections from the fields to the fastening strip resulting from the particular spatial position of the fields can preferably be produced on an embossing machine suitable for this purpose.

Although it is possible to arrange the longitudinal edges of the fields at different angles relative to the parallel planes, on the one hand, and relative to the plane intersecting the longitudinal edges of the fins, on the other hand, the features of claim 5 provide that these angles are of equal size.

In order to ensure a deflection of the cooling air in the air conduction grooves which is as irrotational as possible, in accordance with claim 6, the transition sections have a radius of 1.5 mm to 3 mm.

In addition, internal tests have shown that optimum heat transfer conditions prevail especially when, in accordance with claim 7, the distance between two transverse planes which extend perpendicularly to the line of symmetry of an air conduction groove and intersect successive curvature centers in longitudinal direction of an air conduction groove, is approximately 7.5 mm to 25 mm, preferably approximately 10 mm.

Furthermore, a further optimization of the heat transfer conditions can be achieved if, in accordance with claim 8, the point of intersection of the center lines of two successive groove sections of an air conduction groove is arranged at a distance of approximately 2.5 mm to 5 mm, preferably approximately 3.5 mm, from the line of symmetry of the air conduction groove.

As a result of the distance between the transverse planes of two successive curvature center points of an air conduction groove and the distance of the points of intersection of the center lines of two successive groove sections from the line of symmetry, the distance between a transverse plane intersecting a curvature center point and the points of intersection of the adjacent center lines of the groove sections with the line of symmetry, is approximately 3 mm no 10 mm, preferable approximately 7.5 mm.

In accordance with the invention, it is also advantageous if, according to claim 9, the air conduction grooves have a semicircular cross section with a radius and a depth of approximately 1 mm to 2 mm, preferably approximately 1.5 mm.

The uniform shape of the air guide grooves—preferably on both side surfaces of the fins—is optimized in accordance with claim 10 if the distance between the center lines of two adjacent air conduction grooves is approximately 4.5 mm to 6 mm, preferably approximately 5.0 mm. This results in a ratio of the distance of two transverse planes intersecting successive curvature center points in longitudinal direction of an air conduction groove relative to the distance between two center lines of two adjacent air conduction grooves of approximately 3.5:1 to 4.5:1, preferably 4:1.

Finally, a further improvement of the heat transfer conditions is achieved in accordance with claim 11 when the distance between two adjacent fins is approximately 2 mm to 4 mm, preferably approximately 3 mm.

BRIEF DESCRIPTION OF THE DRAWING

In the following, the invention will be explained in more detail with the aid of embodiments illustrated in the drawings.

In the drawings.

DESCRIPTION OF THE PREFERRED EMBODIMENT

Figure 1:
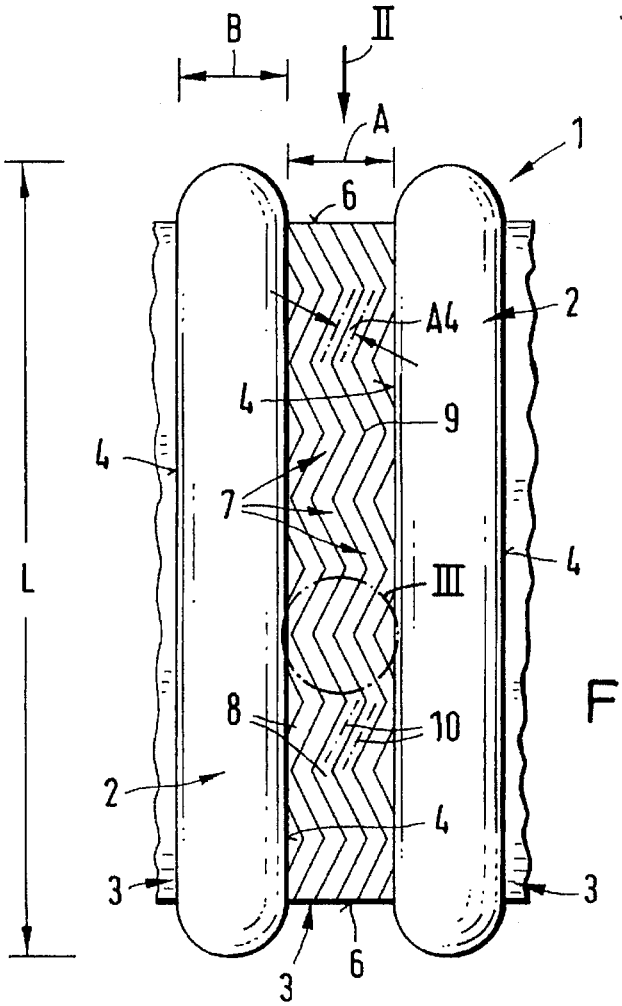
FIG. 1 is a schematic vertical sectional view of a portion of a finned tube heat exchanger.
Figure 2:
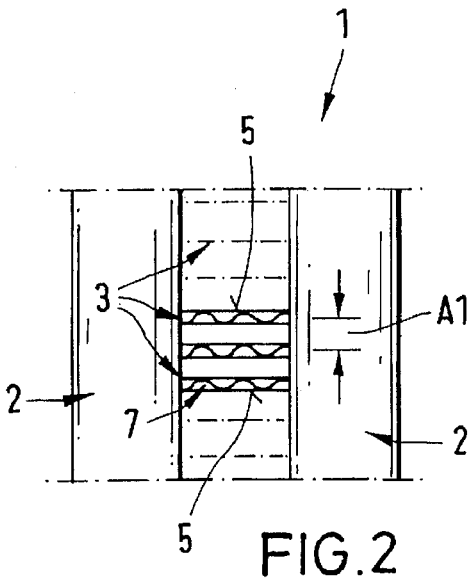
FIG. 2 is a partial view of the finned tube heat exchanger in accordance with arrow II of FIG. 1.
Figure 3:
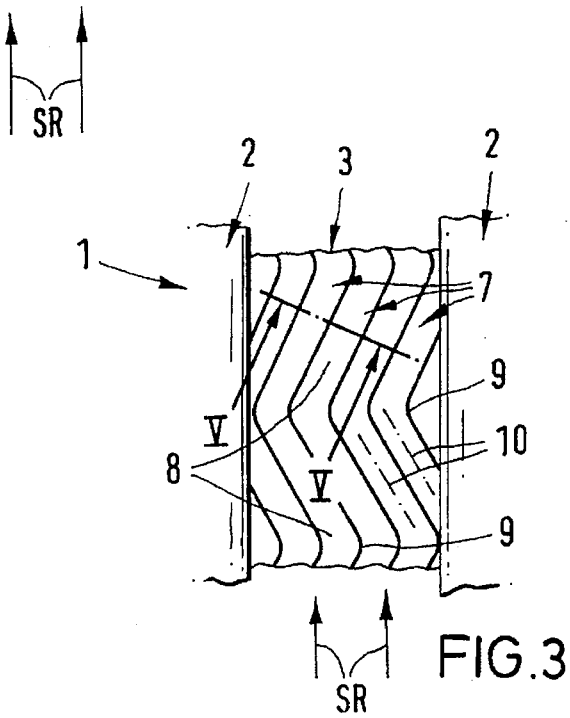
FIG. 3 is a view, on a larger scale, of detail III of FIG. 1.

In FIGS. 1–3, a portion of a finned tube heat exchanger for the condensation of the exhaust steams of large turbine plants of cooling air is denoted by 1.

The finned tube heat exchanger 1 has several heat exchanger tubes 2 having an oblong cross section, wherein the heat exchanger tubes 2 are arranged parallel and next to one another at a distance A. The heat exchanger tubes 2 are connected to one another by fins 3 which extend parallel to the flow direction SR of the cooling air and are fastened by suitable fixing strips perpendicularly on the lateral surfaces 4 of the heat exchanger tubes 2.

FIG. 1 shows that the length L of the cross section of the heat exchanger tubes 2 is greater by a multiple than the width B.

The fins 3 arranged at a distance A1 of 3 mm from each other (FIGS. 2 and 5) have on both side surfaces 5 continuous air conduction grooves 7 which are arranged in a zig-zag-shaped configuration parallel next to one another and extend in flow direction SR of the cooling air. The air conduction grooves 7 are open at the ends 6 of the fins. The air conduction grooves 7 are produced by an appropriate embossment of the fins 3 with a thickness D of approximately 0.1 mm in the case of aluminum or copper, or of approximately 0.5 mm in the case of steel (FIGS. 1–5).

Figure 4:
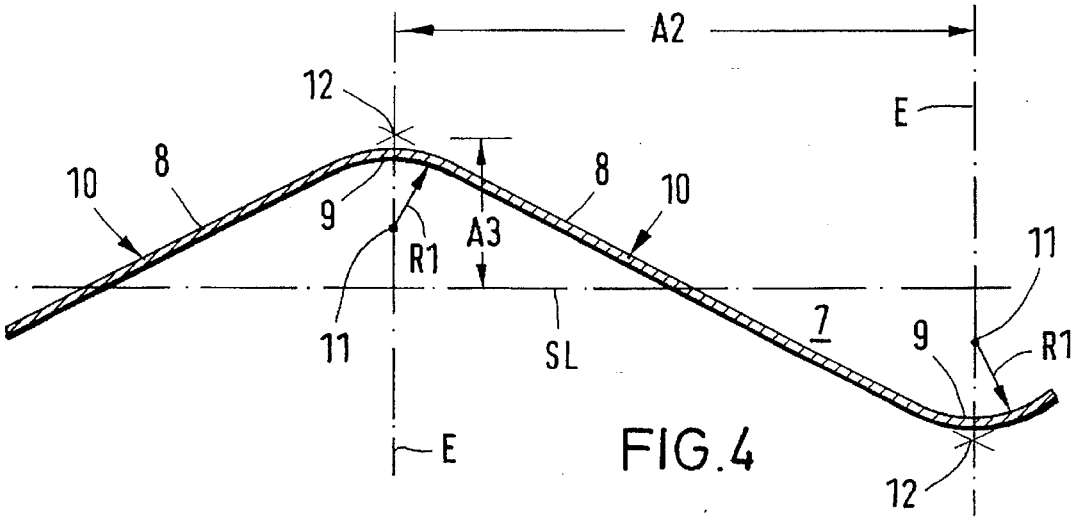
FIG. 4 is a schematic view, on a larger scale, showing the shape of an air conduction groove.

Each air conduction groove 7 is composed of straight groove sections 8 and two arc-shaped transition sections 9 which steplessly connect two successive groove sections 8 (FIGS. 1, 3 and 4). FIG. 4 shows on a larger scale the geometric conditions of an air conduction groove 7 with the aid of the center lines 10 of two successive groove sections 8 shown in wider lines.

Accordingly, it can be seen that the arc-shaped transition sections 9 are curved in a semicircular shape. The curvature center points 11 of the transition sections 9 are located at a distance from the symmetry line SL of the air conduction groove 7. The transition sections 9 have a radius R1 of 1.5 mm to 3 mm. The distance A2 between two transverse planes E which intersect successive curvature center points 11 is 10 mm. The point 12 of intersection of the center lines 10 of two successive groove sections 8 is arranged at a distance A3 of 3.5 mm from the symmetry line SL.

Figure 5:
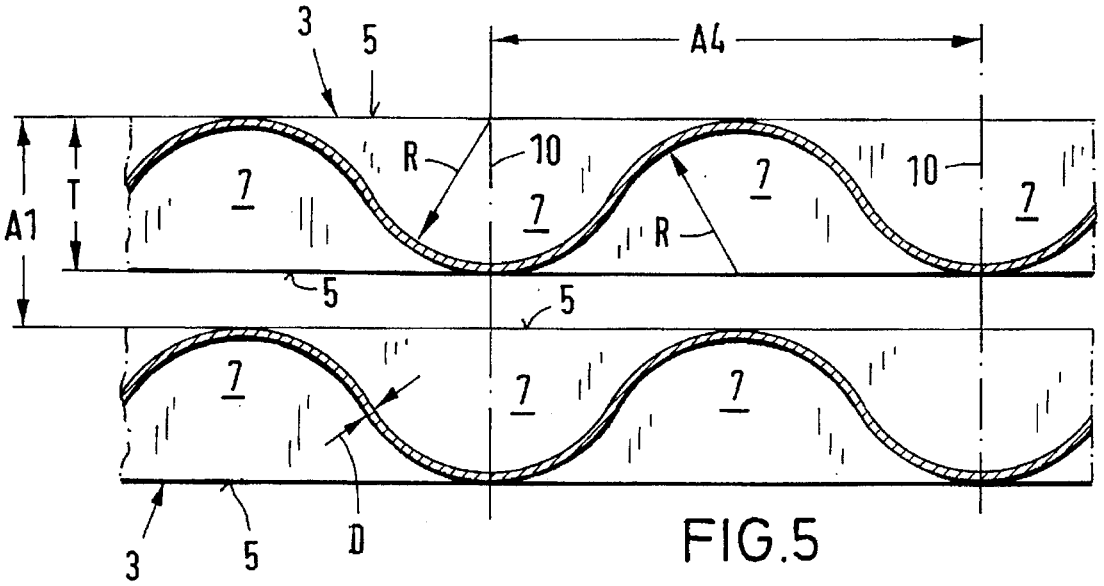
FIG. 5 is a sectional view, on a larger scale, of the illustration of FIG. 3 taken along line V—V.

FIG. 5 further shows that the air conduction grooves 7 have a semicircular cross section with a radius R and a depth T of 1.5 mm.

The distance A4 between the center lines 10 of two adjacent air conduction grooves is 5.0 mm (FIGS. 1 and 5).

Figure 6:
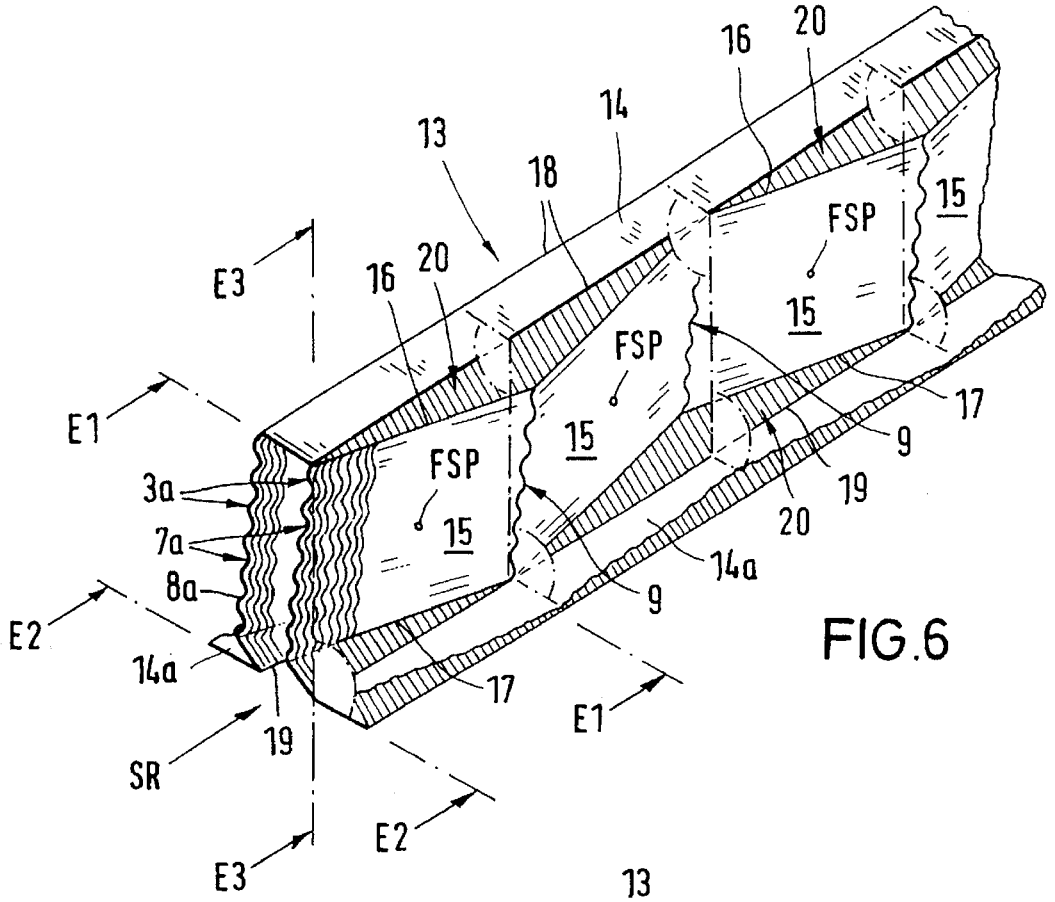
FIG. 6 is a perspective view of a portion of a U-shaped fin strip.
Figure 7:
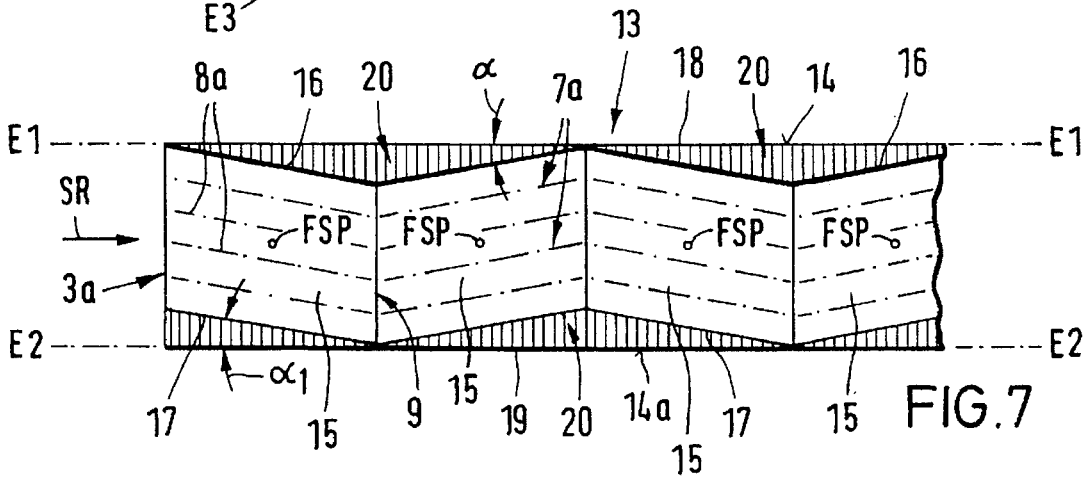
FIG. 7 is a side view of the fin strip of FIG. 6.
Figure 8:
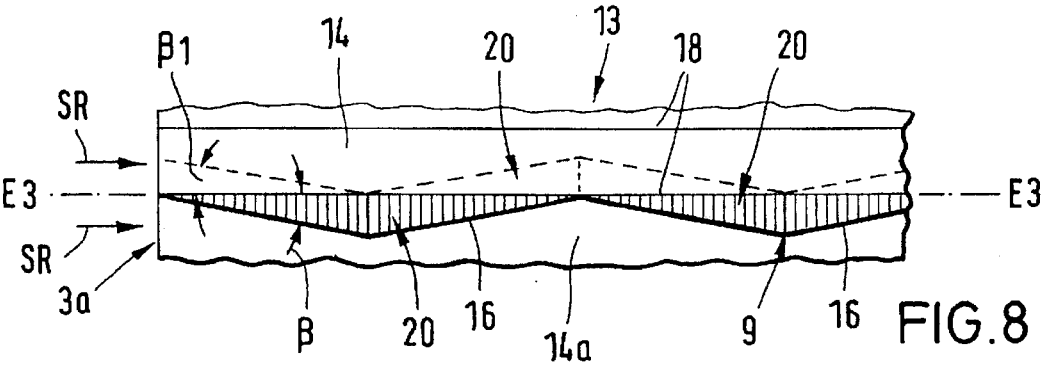
FIG. 8 is a top view of the fin strip of FIG. 6.

The U-shaped fin strip 13 of FIGS. 6 to 8 is composed of a plurality of fins 3*a* and the fastening strips 14, 14*a* which connect the fins 3*a* and which, simultaneously, serve for securing the fin strip 13 to the heat exchanger tubes 2. The fastening strips 14 extending in the plane E1—E1 extend parallel to the fastening strips 14*a* which extend in the plane E2—E2.

Specifically, the embodiment of the invention illustrated in FIGS. 6–8 is composed of a corrugated fin strip, with the air guiding grooves formed in the flat sections of the strip extending between the crests and troughs of the corrugated strip.

The fins 3*a* are divided in longitudinal direction into several zig-zag-shaped successive fields 15 with parallel groove sections 8*a*. Also in this case, as in the embodiment of FIGS. 1 to 5, the groove sections 8*a* are components of the air conduction grooves 7*a* which extend continuously over the length of the fins 3*a*.

The longitudinal edges 16, 17 of the fields 15 extend at the angle $\alpha$, $\alpha 1$ to the fastening strips 14, 14*a* extending in the parallel planes E1—E1, E2—E2, as well as at the angle $\beta$, $\beta 1$ to the plane E3—E3 intersecting the longitudinal edges 18, 19 of each fin 3*a*. The angles $\alpha$, $\alpha 1$, $\beta$, $\beta 1$ are 14°.

As a result of the fields 15 extending obliquely in space and formed about the axes extending through the center FSP of gravity of the surface of the fields 15, slender triangular portions 20 are formed in longitudinal direction of the fins 3*a* between the longitudinal edges 16, 17 of the fields 15 and the longitudinal edges 18, 19 of the fins 3*a*.

The configuration of the fins 3*a* and the air conduction grooves 7*a* formed in the fins 3*a* otherwise corresponds to the configuration of the ribs 3 and the air conduction grooves 7 of the embodiment of FIGS. 1 to 5, so that it is not necessary to repeat the explanation.

I claim:

1. A finned tube heat exchanger, particularly for the condensation of exhaust steams of large turbine plants by means of cooling air, the finned tube heat exchanger comprising heat exchanger tubes with a plurality of parallel fins between pairs of the heat exchanger tubes, each fin having an oblong cross section in a flow direction of the cooling air, the cross section of each fin having a length and a width, wherein the length of the cross section is a multiple greater than the width thereof, the fins extending parallel to the flow direction of the cooling air and perpendicularly to axes of the heat exchanger tubes, further comprising flow conduction devices comprising air conduction grooves formed on at least one side surface of the fins, wherein the air conduction grooves extend in a zig-zag-shaped configuration parallel next to each other, and wherein the air conduction grooves extend continuously along the flow direction of the cooling air and are open at ends of the fins.

2. The finned tube heat exchanger according to claim 1, wherein groove sections of the air conduction grooves extending at an angle relative to each other are straight.

3. The finned tube heat exchanger according to claim 1, wherein two successive groove sections of an air conduction groove are steplessly connected to one another by an arc-shaped transition section.

4. The finned tube heat exchanger according to claim 1, wherein the fins are provided at both longitudinal edges thereof with fastening strips extending in parallel planes and in opposite directions are divided into a plurality of zig-zag-shaped successive fields with parallel groove sections, wherein the fields have longitudinal edges extending at a first angle relative to the parallel planes and at a second angle relative to a plane intersecting the two longitudinal edges of a fin.

5. The finned tube heat exchanger according to claim 4, wherein the first angle and the second angle are of equal size.

6. The finned tube heat exchanger according to claim 3, wherein the transition section has a radius of 1.5–3 mm.

7. The finned tube heat exchanger according to claim 3, wherein two transverse planes intersecting successive curvature center points of the transition sections in longitudinal direction of an air conduction groove are spaced apart from each other by a distance of approximately 7.5 mm–25 mm.

8. The finned tube heat exchanger according to claim 7, wherein the distance is 10 mm.

9. The finned tube heat exchanger according to claim 3, wherein a point of intersection of center lines of two successive groove sections of an air conduction groove is located at a distance of approximately 2.5 mm–5 mm from a symmetry line of an air conduction groove.

10. The finned tube heat exchanger according to claim 9, wherein the distance is approximately 3.5 mm.

11. The finned tube heat exchanger according to claim 10, wherein each air conduction groove has a semicircular cross section with a radius and a depth of approximately 1 mm–2 mm.

12. The finned tube heat exchanger according to claim 11, wherein the radius and the depth are approximately 1.5 mm.

13. The finned tube heat exchanger according to claim 1, wherein a distance between center lines of two adjacent air conduction grooves is approximately 4.5 mm–6 mm.

14. The finned tube heat exchanger according to claim 13, wherein the distance is approximately 5.0 mm.

15. The finned tube heat exchanger according to claim 1, wherein a distance between adjacent fins is approximately 2 mm–4 mm.

16. The finned tube heat exchanger according to claim 15, wherein the distance is approximately 3 mm.

* * * * *